US005853325A

United States Patent [19]

Kadlic

[11] Patent Number: 5,853,325

[45] **Date of Patent: *Dec. 29, 1998**

[54] METHOD OF PLAYING AN ELECTRONIC RUMMY GAME APPARATUS

[76] Inventor: Thomas P. Kadlic, 4505 W. Hacienda Ave. Suite, #G, Las Vegas, Nev. 89118

[ * ] Notice: The term of this patent shall not extend beyond the expiration date of Pat. No. 5,601,488.

[21] Appl. No.: 794,291

[22] Filed: Feb. 3, 1997

Related U.S. Application Data

[63] Continuation-in-part of Ser. No. 336,271, Nov. 8, 1994, Pat. No. 5,601,488.

[51] Int. Cl.[6] ..... A63F 1/00

[52] U.S. Cl. ..... 463/13; 273/292

[58] Field of Search ..... 463/13; 273/292

[56] References Cited

U.S. PATENT DOCUMENTS

| | | | |
|---|---|---|---|
| 5,042,818 | 8/1991 | Weingardt | 463/13 |
| 5,255,915 | 10/1993 | Miller | 463/13 |
| 5,356,140 | 10/1994 | Dabrowski et al. | 463/12 |
| 5,601,488 | 2/1997 | Kadlic | 463/13 |

OTHER PUBLICATIONS

Hoyle's Modern Encyclopedia Of Card Games, Walter Gibson, Doubleday & Company, Inc., pp. 278–283, "Big Bobtail", Little Bobtail, Dec. 1974.

The World's Greatest Gaming Catalog, John Patrick Productions, p. 16 "Hand Held Video Poker", Jan. 1993.

*Primary Examiner*—Benjamin H. Layno
*Attorney, Agent, or Firm*—John Edward Roethel

[57] ABSTRACT

The method of the present invention involves a game of chance based on the principles of rummy. An electronic gaming machine is programmed to display an initial hand of at least six cards, and preferably seven cards, to the player. The player selects which of the initial cards to hold and which to discard. Replacement cards are displayed for the cards which have been discarded and the combinations created by the resulting final hand are compared against a payout table to determine which winning payoffs, if any, are received by the player. Preferred winning combinations are seven, six, five and four card runs, four and three card groups and the combination (sets) of three or four card runs and three or four card groups. The method of the present invention can also be practiced on a non-gaming amusement device in which the player accrues points for winning plays. The non-gaming amusement device can take the form of a hand-held amusement device operated by batteries or other suitable power sources, a stand-alone amusement apparatus or a video cartridge suitable for use with an entertainment system.

27 Claims, 5 Drawing Sheets

| | 1st COIN | 2nd COIN | 3rd COIN | 4th COIN | 5th COIN |
|---|---|---|---|---|---|
| ANY 7 CARD RUN | $1,000 | $2,000 | $3,000 | $4,000 | MEGA JACKPOT SUPER JACKPOT |
| ANY 6 CARD RUN | $250 | $500 | $750 | $1000 | |
| ANY 5 CARD RUN | 250 | 500 | 750 | 1000 | 4,000 |
| 2 SETS ANY 3 & 4 | 25 | 50 | 75 | 100 | 125 |
| 2 SETS OF ANY 3 | 8 | 16 | 24 | 32 | 40 |
| 4 OF A KIND | 4 | 8 | 12 | 16 | 20 |
| ANY 4 CARD RUN | 3 | 6 | 9 | 12 | 15 |
| 3 OF A KIND | 2 | 4 | 6 | 8 | 10 |
| ANY 3 CARD RUN | 1 | 2 | 3 | 4 | 5 |

METHOD OF PLAYING AN ELECTRONIC RUMMY GAME APPARATUS

CROSS-REFERENCE TO RELATED APPLICATION

This application is a Continuation-in-Part of application Ser. No. 08/336,271, filed Nov. 8, 1994, entitled "Electronic Rummy Game", now U.S. Pat. No. 5,601,488.

BACKGROUND OF THE INVENTION

This invention relates to the method of play of a rummy game, and more particularly to the method of play of a rummy game designed to be displayed on an electronic video gaming device for use in licensed gaming establishments. The invention also relates to the method of play of an electronic rummy game that can be played as a non-gaming amusement game on a hand held apparatus or programmed on a stand alone amusement apparatus or onto a video cartridge that can be used with a television video entertainment system. The invention also relates the method of play of a rummy game which can be played as a live casino table game or as a live non-gaming amusement game.

There have been many types of electronic video gaming machines that have been developed. The electronic video poker gaming machine is designed to replicate the play of a hand of poker. Typically, the player is not playing against any other players or against a dealer's hand; the player is simply attempting to achieve the highest ranking poker hand possible from the cards displayed to the player. The higher the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. A payout table is established based on the number of coins, tokens or credits wagered by the player and the type of poker hand achieved.

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Other types of poker games have been adapted to run on electronic video gaming machines. In the electronic version of seven card stud poker, the player wagers one or more coins, tokens or credits to be eligible to play the game and the player is dealt three cards initially. The player then has the option of folding in which case he loses his initial wager or betting additional coins, tokens or credits to receive additional cards. Eventually the player has either folded or received a full seven card hand. The player wins or loses based on conventional poker hand rankings for the best five cards of his seven card hand. A payout table is established based on the number of coins, tokens or credits wagered by the player and the type of poker hand achieved.

In the electronic version of five card stud poker, the player wagers one or more coins, tokens or credits to be eligible to play the game and the player is dealt four cards initially. The player then has the option of staying or betting additional coins, tokens or credits to increase the amount of a winning payout when he receives the fifth card. After the fifth card is dealt to the player, the value of his five card hand is determined based on conventional poker hand rankings for his five card hand. A payout table is established based on the number of coins, tokens or credits wagered by the player and the type of poker hand achieved.

Some of the card games adapted to electronic video gaming machines display both the player's hand and a dealer's hand. This occurs in those games where the player must beat the dealer in order to win.

In the electronic version of Twenty-One, the player is dealt two cards and the dealer is dealt two cards from a conventional deck of playing cards. Only one of the dealer's cards is exposed to the player. The player stands or hits based on the conventional manner of play of Twenty-One and after the player has completed the play of his hand, the dealer stands or hits as is conventional. The player wins if his hand totals more than the dealer's hand without going over the total of 21. If the player has a winning hand, he is paid one-to-one odds based on the amount of his wager. Blackjacks pay three-to-two odds and electronic Twenty-One gaming machines can be programmed to allow the player to perform conventional Twenty-One features such as doubling down, splitting pairs and taking insurance.

Many of these electronic gaming machines have been adapted into amusement devices by eliminating the wagering aspects of the games. There exist hand-held, battery powered apparatus that replicate video draw poker and many of its variations that are played as amusement devices. The user simply plays the particular video poker game on the hand held amusement device and accumulates points instead of credits that can be redeemed as money.

Because of the proliferation of legalized gaming, the competition for players has increased. Operators of gaming machines have been increasing the payback percentage to attract players and the increase of the gaming percentage has resulted in a lowering of profits to the operators. There is a demand in the market for new gaming machines that create a higher volume of play so that profits can be increased even with the higher payback percentages that the players desire.

Rummy games have been popular card games played often in a family setting around the kitchen or dining room table. According to "Scarne's Encyclopedia of Games", Rummy evolved from Whiskey Poker. By the mid 1890's, there were three popular versions of poker being played (all so named because they were played in bars for alcoholic drinks): Whiskey Poker now known generally as Knock Rummy, Gin Poker now known as Gin Rummy and Rum Poker now known as Rummy.

Rummy is generally played using one or more decks of standard playing cards—the standard fifty-two card decks having four suits (Spades, Hearts, Diamonds and Clubs ranking upward from deuce through Ace). One of the basic, widespread principles of Rummy games is that the player must attempt to organize his hand into what are known as "groups" and "runs". A "group" is a collection of like cards, e.g. Kings, Threes or Sixes and normally a player must have either a three card group or a four card group. A "run" is a sequence of cards of the same suit, e.g. the Four, Five and Six of Spades and normally a player must have a sequence of at least three cards in length.

It is an object of the present invention to provide a method of playing a game of chance based on rummy which is easily understood by the player and that uses only the player's hand to determine winning and losing outcomes.

It is a feature of the present invention to display a method of playing a game of chance based on rummy on an electronic gaming machine. An initial hand of cards is displayed to the player who discards and redraws replacement cards while attempting to achieve various winning combinations modeled after traditional rummy games. It is also a feature of the present invention to display the method of playing a game of chance on a non-gaming amusement device such as a hand held amusement apparatus, a stand alone arcade game or even programmed on a video cartridge that can be used with an entertainment system that can be connected to a television set.

It is an advantage of the present invention that a new and creative game of chance is provided to the player presenting multiple winning combinations based on traditional rummy combinations; while at the same time including high progressive jackpot amounts or high point awards that may be achieved by the player.

Other objects, features and advantages of the present invention will become apparent from a consideration of the following detailed description.

SUMMARY OF THE INVENTION

The method of the present invention involves a game of chance based on the principles of rummy and that uses only the player's hand to determine winning and losing outcomes. An electronic gaming machine is programmed to display an initial hand of at least six cards, and preferably seven cards, to the player. The player selects which of the initial cards to hold and which to discard. Replacement cards are displayed for the cards which have been discarded and the combinations created by the resulting final hand are compared against a payout table to determine which winning payoffs, if any, are received by the player. Preferred winning combinations are seven, six, five and four card runs, four and three card groups and the combination (sets) of three or four card runs and three or four card groups. The method of the present invention can also be practiced on a non-gaming amusement device in which the player accrues points for winning plays. The non-gaming amusement device can take the form of a hand-held amusement device operated by batteries or other suitable power sources, a stand-alone amusement apparatus or a video cartridge suitable for use with an entertainment system.

DETAILED DESCRIPTION OF THE PREFERRED EMBODIMENTS

Figure 1:
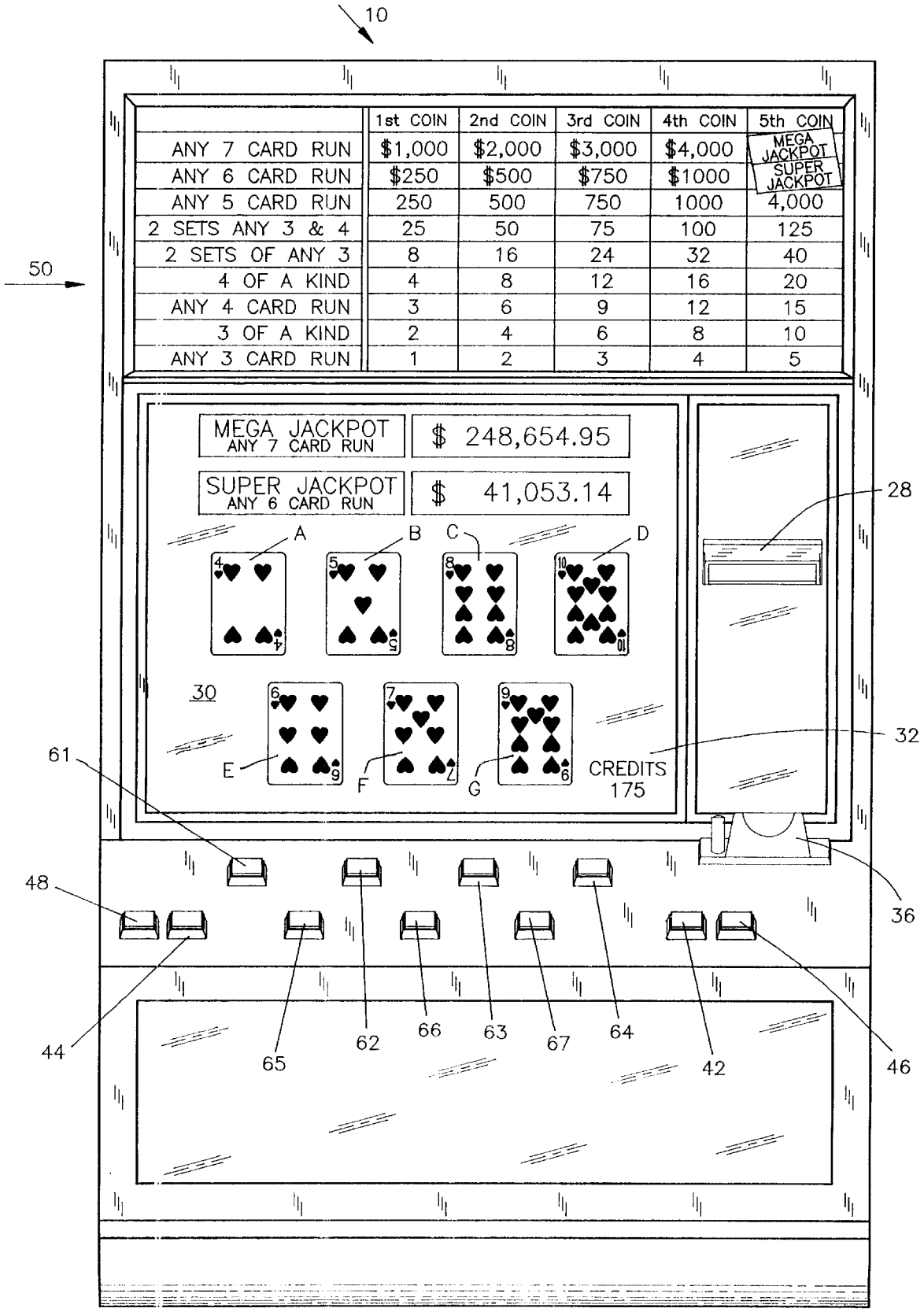
FIG. 1 shows a front view of the exterior of an electronic gaming machine of the present invention.
Figure 2:
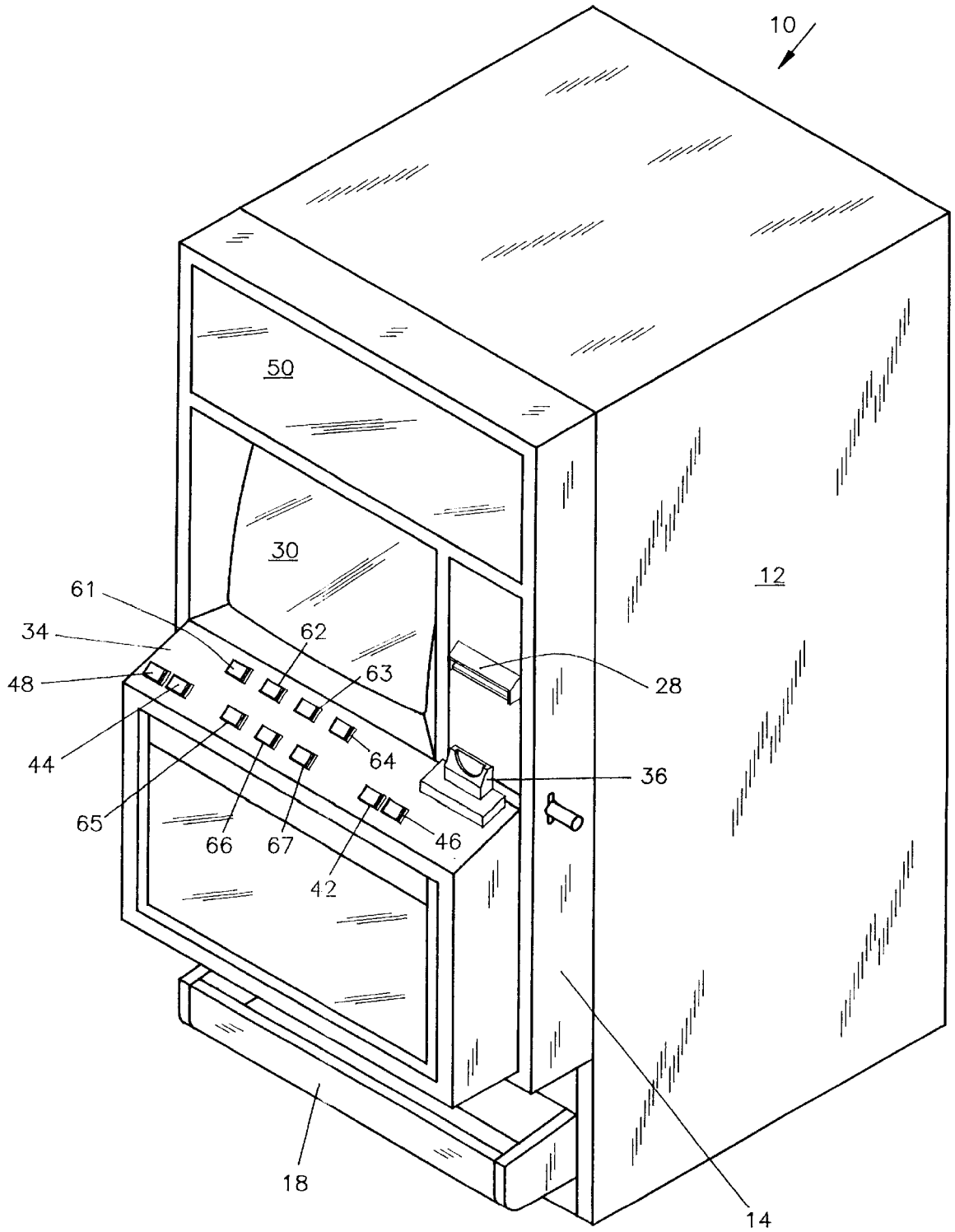
FIG. 2 shows an isometric view of the exterior of an electronic gaming machine of the present invention.
Figure 3:
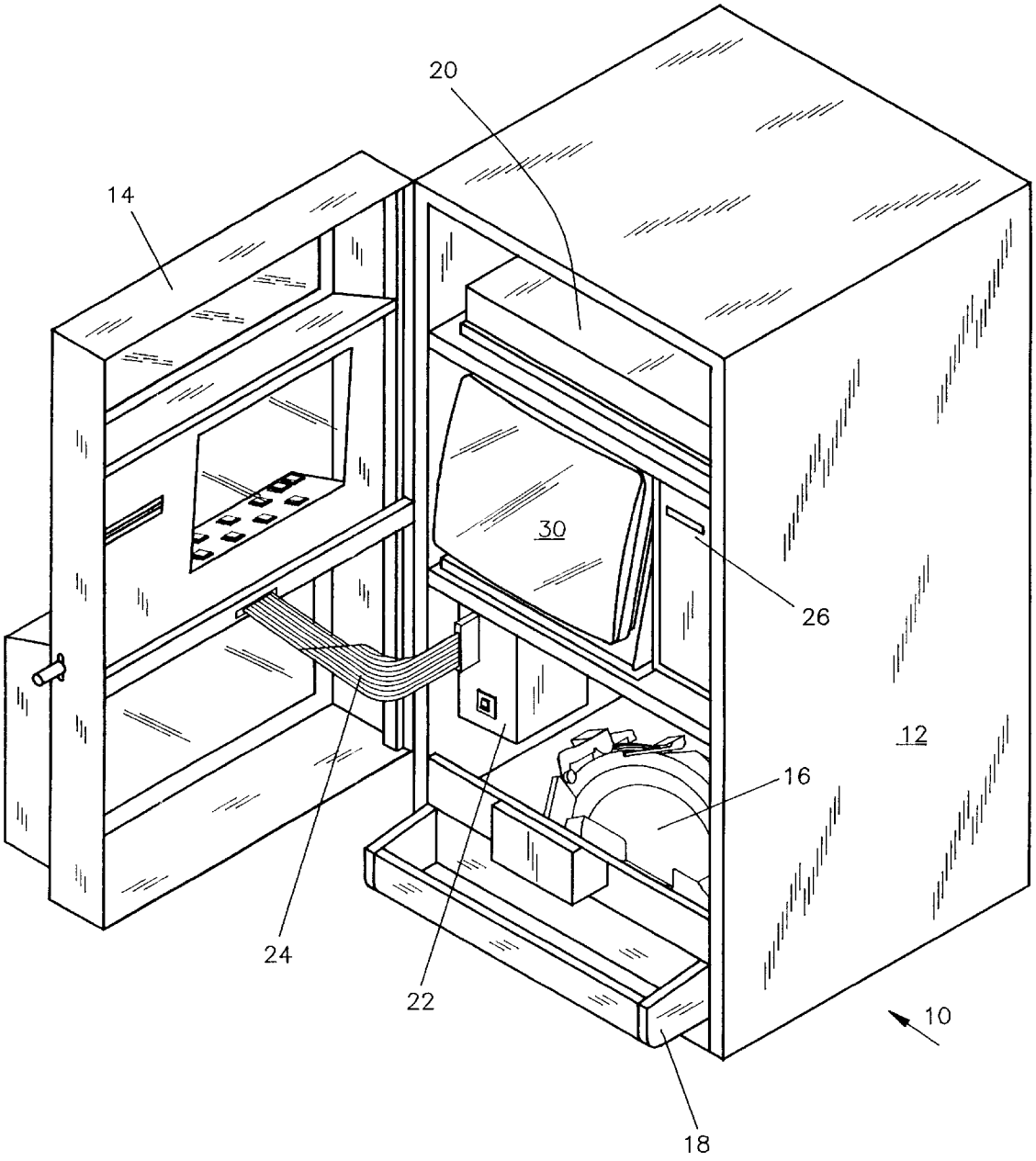
FIG. 3 shows an isometric view of the interior of an electronic gaming machine of the present invention.

An electronic gaming machine, shown at 10 in FIGS. 1, 2 and 3, is configured and programmed to display to the player the method of the gin rummy game of the present invention. The electronic gaming machine 10 comprises a cabinet 12 in which are mounted the operating components of the electronic gaming machine 10. A door 14 is connected to the cabinet 12 in any suitable manner, such as by hinges, and opens to provide access to the interior of the cabinet 12.

On the interior of the electronic gaming machine 10 there is provided a hopper 16 from which coins or gaming tokens are paid to the player. When the hopper 16 is activated, the coins or gaming tokens are dispensed from the hopper 16 into the payout tray 18 mounted on the exterior of the door 14. Alternatively, a ticket printer or credit voucher printer can be used to report the number of credits accrued by the player when the player decides to discontinue playing the gaming machine.

The operational control of the electronic gaming machine 10 is performed by an electronic circuit board 20 which holds the computer chips and other electronic elements necessary to operate the electronic gaming machine 10. The electronic circuit board 20 includes the electronic circuitry necessary to operate the video screen 30, the play buttons on the button panel 34, the coin head 36, the currency acceptor mechanism 26 and the hopper 16. A conventional electronic circuit board 20 structure is utilized, similar to the electronic circuit boards used in other electronic gaming machines. A specially programmed computer chip, such as an EPROM or other suitable device, is attached to the electronic circuit board and effects the operations of the electronic gaming machine necessary to allow a player to engage in the game of the electronic gin rummy as hereinafter described. The electronic circuit board 20 is electronically coupled to the power supply 22 which likewise is electronically coupled by means of the wiring harness 24 to the operating buttons mounted on the button panel 34 on the door 14 of the electronic gaming machine 10. Alternatively, the wiring harness 24 can be replaced by other connectivity means such as RF, optics such as infrared or other suitable means.

Also on the interior of the cabinet 12 is a currency acceptor mechanism 26 which receives currency used by the player to activate the electronic gaming machine 10. The currency acceptor mechanism 26 is positioned directly behind the currency slot 28 on the cabinet 12. When the currency acceptor mechanism 26 validates the currency inserted therein, the appropriate number of credits corresponding to the value of the currency are displayed on the credit display 32. Alternatively coupons, credit vouchers or other currency equivalent devices can be inserted into the currency acceptor mechanism which can be programmed to validate such instruments.

If the player desires to use coins or gaming tokens (instead of currency or currency equivalents) to operate the electronic gaming machine 10, the coins or gaming tokens are inserted into the electronic gaming machine 10 by means of the coin head 36 on the button panel 34. By means of conventional coin chutes (not shown), the coins inserted into the coin head 36 are collected in the hopper 16 from which they are available to make payouts to the player. As is conventional in gaming machines of this type, the insertion of coins or gaming tokens activates the gaming machine for use by the player.

A video screen 30, or any other appropriate form of a video display such as an LED screen, is also electronically connected to the electronic circuit board 20. The video screen 30 displays the play of the game to the player. The video screen 30 will display the playing cards used during the method of play of the game and the video screen 30 also has a credit display 32 which shows the player the number of credits currently available to the player which the player may either use to play the game or which the player may cash out when he has concluded playing the game. The player may cash out his accrued credits as coins or tokens directly into the payout tray 18 if a hopper 16 is used. Alternatively, other cashing out devices such as a ticker printer or a credit voucher printer may be used.

In the preferred embodiment of the present invention, the apparatus operates as follows:

A computer chip, such as an EPROM, is mounted on the electronic circuit board 20 and the computer chip is programmed to display to the player the method of play of the electronic gin rummy game. When a player inserts a coin or gaming token into the coin head 36 and the coin or gaming token is accepted by the coin acceptor mechanism mounted adjacent to the coin head 36, a signal is sent from the coin acceptor mechanism to the electronic circuit board 20 which then increments the credit display 32 to show that the player has inserted coins or tokens. Alternatively, when a player inserts currency into the currency slot 28 and the currency is accepted by the currency acceptor mechanism 26, a signal is sent from the currency acceptor mechanism 26 to the electronic circuit board 20 which then increments the credit display 32 the requisite number of credits corresponding to the value of the currency inserted by the player. In addition to using coin/token acceptor mechanisms or currency acceptor mechanisms or both, the method and apparatus of the present invention is intended to also include credit coupons, credit or debit card systems, magnetically or optically read memory storage cards or any other apparatus or system by which monetary value can be input by the player and eventually displayed on the credit display 32 on the gaming machine.

Once the player has accrued credits on the credit display 32 by either inserting coins, gaming tokens or currency (or any of the other apparatuses or systems mentioned above), the electronic gaming machine 10 is active to be played. In one embodiment of the present invention, the player makes a wager by pressing either the Bet Max button 42 (to wager the maximum number of credits for any one hand—typically five) or the Bet One button 44 to wager one credit at a time. When the player presses a button, a signal is sent to the electronic circuit board 20 and the credit display 32 is decremented the number of credits wagered by the player. As shown in the drawings, this signal can be transported through a wiring harness 24 which directly electronically connects the buttons to the electronic circuit board 20. Alternatively any other means of electronic communication can be used such as RF or optics including infrared communication.

Furthermore, instead of using player-actuated buttons on the button panel 34, the video screen 30 can be a touch-activated screen of the type currently being used extensively in electronic video gaming apparatus. The desired actions the player wishes to effect are accomplished by the player simply touching the video screen in the designated location on the screen. When the player touches the designated location on the video screen 30, a signal is sent to the electronic circuit board 20 to effect the action sought by the player.

After the player has selected the number of credits he wishes to wager on that hand, the player presses the Deal/Draw button 46 (or presses the designated Deal/Draw location on the video screen 30) which sends a signal through the wiring harness 24 to electronic circuit board 20 (or alternatively the signal is sent by RF or optically such as by infrared). The computer chip on the electronic circuit board 20, after having electronically randomly shuffled the playing cards, causes playing cards to be displayed on the video screen 30. In the preferred embodiment of the present invention, seven playing cards are displayed: card A, card B, card C, card D, card E, card F and card G. The computer chip on the electronic circuit board 20 is programmed to use a standard deck of fifty-two playing cards. The cards have the conventional four suits (Spades, Hearts, Diamonds and Clubs) and rank in order from Deuce through Ace. The cards are electronically shuffled, using any suitable shuffling algorithm or method, prior to each hand so as to select cards randomly to be displayed to the player.

After the initial deal of the cards, the player may choose which of the playing cards he wishes to hold (or discard depending on how the gaming apparatus is configured) by pressing the corresponding buttons: Card A button 61, Card B button 62, Card C button 63, Card D button 64, Card E button 65, Card F button 66 and/or Card G button 67. Alternatively, if touch screen technology is being used, the player merely touches those cards that the player wishes to hold (or that the player wishes to discard depending on how the gaming apparatus is configured).

After the player has selected which cards to hold, the player again presses the Deal/Draw button 46 (or the appropriate location on the touch screen). This results in a signal being sent to the electronic circuit board 20. The computer chip, in response to this signal, causes the cards not held to be removed from the video screen 30 and replaced with other cards from the deck resulting in a final hand being displayed to the player.

The computer chip on the electronic circuit board 20 also determines whether a winning hand combination has been achieved. This is done by electronically comparing the final displayed hand of cards against a pre-established collection of winning hand combinations stored in the computer chip memory. If the final hand is a winning hand, then the player is awarded credits corresponding to the type of winning hand and the number of credits wagered. When the player achieves a winning hand, the credit display 32 on the video screen 30 is incremented with the number of credits that the player has won all through the control of the computer chip on the electronic circuit board 20.

At the conclusion of any hand of play, the player may press the Cash Out button 48 (or the appropriate location on the touch screen) which causes a signal to be sent to the electronic circuit board 20. The circuitry on the electronic circuit board 20 then causes the hopper 16 to be activated to dispense into the payout tray 18 coins or gaming tokens corresponding to the number of credits then displayed on the credit display 32. Alternatively, if other payout apparatus is being used, the player activating the cash out sequence will cause the payout to occur, for example, a ticket representing the monetary value of the player's accrued credits being printed by a ticket printer. The method and apparatus of the present invention is intended to also include credit coupons, credit or debit card systems, magnetically or optically read memory storage cards or any other apparatus or system by which monetary value can be paid or dispensed to the player.

In the preferred embodiment of the present invention, the computer chip memory is programmed with nine pre-established winning hand combinations. The highest payoff for a winning combination is a seven card run: a sequence of seven cards in a row in the same suit. For example, the video screen 30 in FIG. 1 shows a player having achieved a seven card run, i.e. the 4♥, 5♥, 6♥, 7♥, 8♥, 9♥ and 10♥. The order that the cards appear on the video screen 30 does not matter in this embodiment of the invention; the hand is determined solely by the highest ranking combination that can be achieved by the seven cards on the video screen 30. Alternatively, winning combinations can be based on the order or sequence of the cards as displayed on the video screen 30. Higher winning amounts, including even progressive jackpot amounts can be awarded if the player achieves certain cards in certain predetermined sequences, such as a Royal Flush in sequence from left-to-right or right-to-left.

In the preferred embodiment of the present invention, the second highest ranking hand is a six card run. This is followed, in the preferred embodiment of the present invention, in ranking by the third highest ranking hand—the five card run.

In the preferred embodiment of the present invention, the fourth highest ranking hand is two sets of any three and any four card combination. There are four possible card arrangements that can achieve this combination: 1) a three card run and four-of-a-kind; 2) a four card run and three-of-a-kind; 3) a three card run and a four card run; and 4) a three-of-a-kind and a four-of-a-kind.

In the preferred embodiment of the present invention, the fifth highest ranking hand is two sets of any three card combination. There are three possible card arrangements that can achieve this combination: 1) two three card runs; 2) two three-of-a-kinds; and 3) a three card run and three-of-a kind.

In the preferred embodiment of the present invention, the four lowest ranking hands are four-of-a-kind, a four card run, three-of-a-kind and a three card run.

In addition to being programmed into the computer chip memory, the winning hand combinations are also posted to the player in the payout schedule 50, typically displayed on the gaming machine above the video screen 30. Alternatively, the payout schedule 50 can be displayed in printed format on the body of the gaming machine (for example, the payout schedule can be imprinted on gaming glass above the video screen 30 as is conventional) or the payout schedule can be displayed on a secondary screen display which the player accesses by pressing a button or by pressing the appropriate location on the touch screen display. As explained below, the payout schedule is a matrix based on various winning hand combinations and the number of coins or the amount of the wager made by the player at the beginning of the round of play of the game.

Table 1 shows a typical payout schedule 50 that is used in the method of the present invention and displayed to the player on the electronic gaming machine 10. Any hand combination that is not shown on the payout schedule is a losing combination.

TABLE 1

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |
| FIVE CARD RUN | 25 | 50 | 75 | 100 | 250 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |

TABLE 1-continued

| Coins Played | 1st | 2nd | 3rd | 4th | 5th |
|---|---|---|---|---|---|
| THREE OF A KIND | 1 | 2 | 3 | 4 | 5 |
| THREE CARD RUN | 1 | 2 | 3 | 4 | 5 |

Based on theoretical probabilities, the payout table shown in Table 1 has a payback percentage of approximately 99.12%, which means that the gaming machine holds approximately 0.88% of the money wagered. This payout schedule is shown for a "break-even" game and would not generate much revenue to the gaming establishment. This payout schedule is used as the starting point for determining other payout schedules. The payback percentage can be adjusted up or down based on the profitability that the operator of the gaming machine desires and whatever regulations are imposed upon the operator by the gaming authority that regulates the use of the gaming machine. Following are examples of payout schedules that can be used with or without progressive jackpots, where the progressive jackpots are funded from the money wagered into the gaming machine.

Table 2 shows one type of payout schedule that is suggested to be used when a progressive jackpot feature is used. The player can win the progressive jackpot when he achieves a seven card run with five coins wagered. This payout schedule maintains a relatively high payout for a Four Card Run while reducing the size of the payouts for a Five Card Run, a Six Card Run and a Seven Card Run.

TABLE 2

| Coins Played | 1st | 2nd | 3rd | 4th | 5th |
|---|---|---|---|---|---|
| SEVEN CARD RUN | 1000 | 2000 | 3000 | 4000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 89.8% which means that the gaming machine holds approximately 10.2% of the money wagered. In the preferred embodiment of the present invention, between 2% and 4% of this money can be added to the progressive jackpot, which allows the progressive jackpot to increase. Such a result would yield approximately 6.2% to 8.2% as the return to the gaming establishment from the play of this machine.

Table 3 shows another different payout schedule that is suggested to be used when a progressive jackpot feature is used. The player can win the progressive jackpot when he achieves a seven card run with five coins wagered. This payout schedule maintains the relatively high payouts for the Seven Card Run while reducing the payouts for a Six Card Run, a Five Card Run and a Four card Run.

TABLE 3

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | 1250 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule also yields a payback percentage of approximately 90% which means that the gaming machine holds approximately 10% of the money wagered. In the preferred embodiment of the present invention, between 2% and 4% of this money can be added to the progressive jackpot, which allows the progressive jackpot to increase. Such a result would yield approximately 6% to 8% as the return to the gaming establishment from the play of this machine.

Table 4 shows another different payout schedule that is suggested to be used when the method of the present invention is practiced without a progressive jackpot feature. This payout schedule maintains the relatively high payouts for the Seven Card Run while reducing the payouts for a Six Card Run, a Five Card Run and a Four Card Run.

TABLE 4

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 500 | 1000 | 1500 | 2000 | 2500 |
| FIVE CARD RUN | 20 | 40 | 60 | 80 | 100 |
| SETS OF 3 & 4 | 13 | 26 | 39 | 52 | 65 |
| FOUR OF A KIND | 9 | 18 | 27 | 36 | 45 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule also yields a payback percentage of approximately 94.6% which means that the gaming machine holds approximately 5.4% of the money wagered. This payout schedule results in a gaming machine that competes quite favorably with standard video Draw Poker.

Table 5 shows another different payout schedule that is suggested to be used when the method of the present invention is practiced without a progressive jackpot feature. This payout schedule maintains the relatively high payouts for the Five Card Run, the Sets of 3 & 4, and the Four Card Run while reducing the payouts for a Six Card Run.

TABLE 5

| Coins Played | 1st | 2nd | 3rd | 4th | 5th |
|---|---|---|---|---|---|
| SEVEN CARD RUN | 10000 | 20000 | 30000 | 40000 | 50000 |
| SIX CARD RUN | 250 | 500 | 750 | 1000 | 1250 |
| FIVE CARD RUN | 25 | 50 | 75 | 100 | 125 |
| SETS OF 3 & 4 | 16 | 32 | 48 | 64 | 80 |
| FOUR OF A KIND | 9 | 18 | 27 | 36 | 45 |
| FOUR CARD RUN | 5 | 10 | 15 | 20 | 25 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 94.6% which means that the gaming machine holds is approximately 5.4% of the money wagered. This payout schedule will compete quite favorably with standard video Draw Poker and will be popular in gaming establishments that provide players with higher intermediate payouts.

Finally, Table 6 shows one type of payout schedule that is suggested to be used when two progressive jackpots are used. The player can win the higher progressive jackpot when he achieves a Seven Card Run with five coins wagered and the player can win the lower progressive jackpot when he achieves a Six Card Run with five coins wagered. This payout schedule maintains lower payouts in the intermediate categories while providing for a large progressive jackpot in two hand combinations.

TABLE 6

| Coins Played | 1st | 2nd | 3rd | 4th | 5th |
|---|---|---|---|---|---|
| SEVEN CARD RUN | 10000 | 20000 | 30000 | 40000 | Prog. |
| SIX CARD RUN | 250 | 500 | 750 | 1000 | Prog. |
| FIVE CARD RUN | 20 | 40 | 60 | 80 | 100 |
| SETS OF 3 & 4 | 12 | 24 | 26 | 48 | 60 |
| FOUR OF A KIND | 8 | 16 | 24 | 32 | 40 |
| FOUR CARD RUN | 4 | 8 | 12 | 16 | 20 |
| SETS OF 3 & 3 | 3 | 6 | 9 | 12 | 15 |
| THREE OF A KIND | 1 | 2 | 3 | 4 | 5 |
| THREE CARD RUN | 1 | 2 | 3 | 4 | 5 |

This payout schedule yields a payback percentage of approximately 88.2% which means that the gaming machine holds approximately 11.8% of the money wagered. In the preferred embodiment of the present invention, approximately 6% of this money can be added to the progressive jackpots (for example 4% to the large jackpot and 2% to the small jackpot), which allows the progressive jackpots to increase. Such a result would yield approximately 6% as the return to the gaming establishment from the play of this machine.

The method of play of the present invention may be modified in many ways and is still considered to be within the scope of the invention. For example, instead of using a standard fifty-two card deck to play the game, one or more jokers may be added. Each joker can be designated as a wild card and, as such, the probabilities of various winning combinations occurring will be changed. Similarly, various cards may be designated as wild cards, such as "deuces wild", which will also change the probability of various winning combinations occurring. Whenever wild cards or jokers are used, the payout table will be modified to reflect the resulting change in the probabilities.

The manner in which the cards are displayed on the video screen 30 can also be modified and still be within the scope of the invention. Instead of using a seven card hand, the method of the present invention can be played using either a six card hand or a hand having eight or more cards.

If a six card hand is used, then the winning card combinations have to be modified. In this embodiment of the present invention, the preferred winning card combinations are six, five, four and three card runs, four and three card groups and the combination (set) of three card runs and three card groups. The most preferred embodiment of this six card version of the preferred invention uses winning card combinations consisting of a Six Card Run, a Five Card Run, a Set of 3 & 3, a Four-of-a-Kind, a Four Card Run, a Three-of-a-Kind and a Three Card Run.

It is also possible to use a seven card display in this method of play. In such a case, after the player discards and receives replacement cards for the final seven card hand, only the best six cards are used in determining winning card combinations.

Similarly, if eight or more cards are used in the method of play, only the best seven cards are used to determine whether the player has achieved a winning card combination. Alternatively, if a six card payout schedule is being used, then the best six cards of the final eight or more cards are used in determining winning hand combinations.

Regardless of how many cards are used in the method of play and how many cards are used in determining whether the player has achieved a winning card combination, the payout schedule is adjusted based on the probabilities of winning card combinations occurring.

Figure 4:
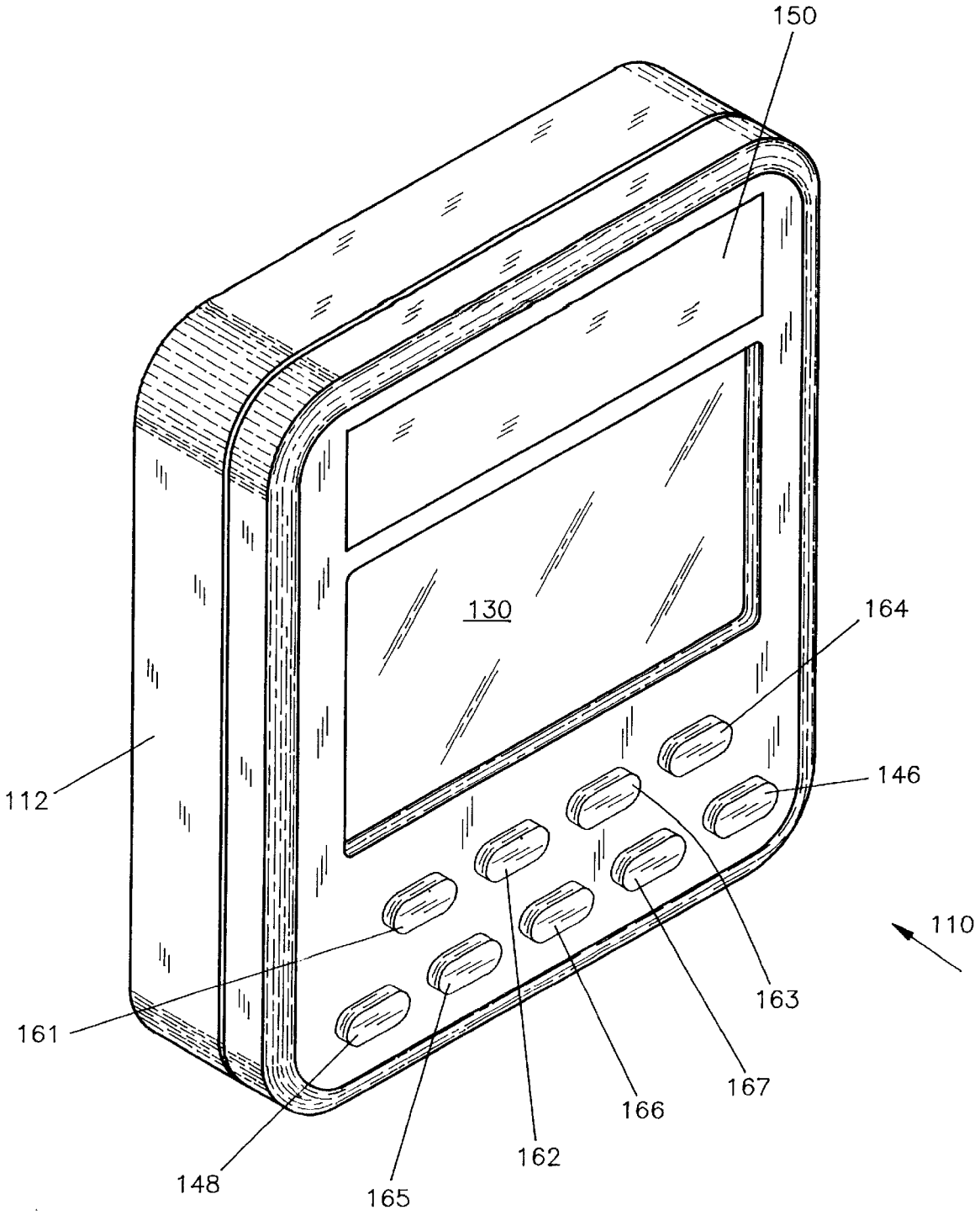
FIG. 4 shows an isometric view of the exterior of a hand held amusement apparatus of the present invention.
Figure 5:
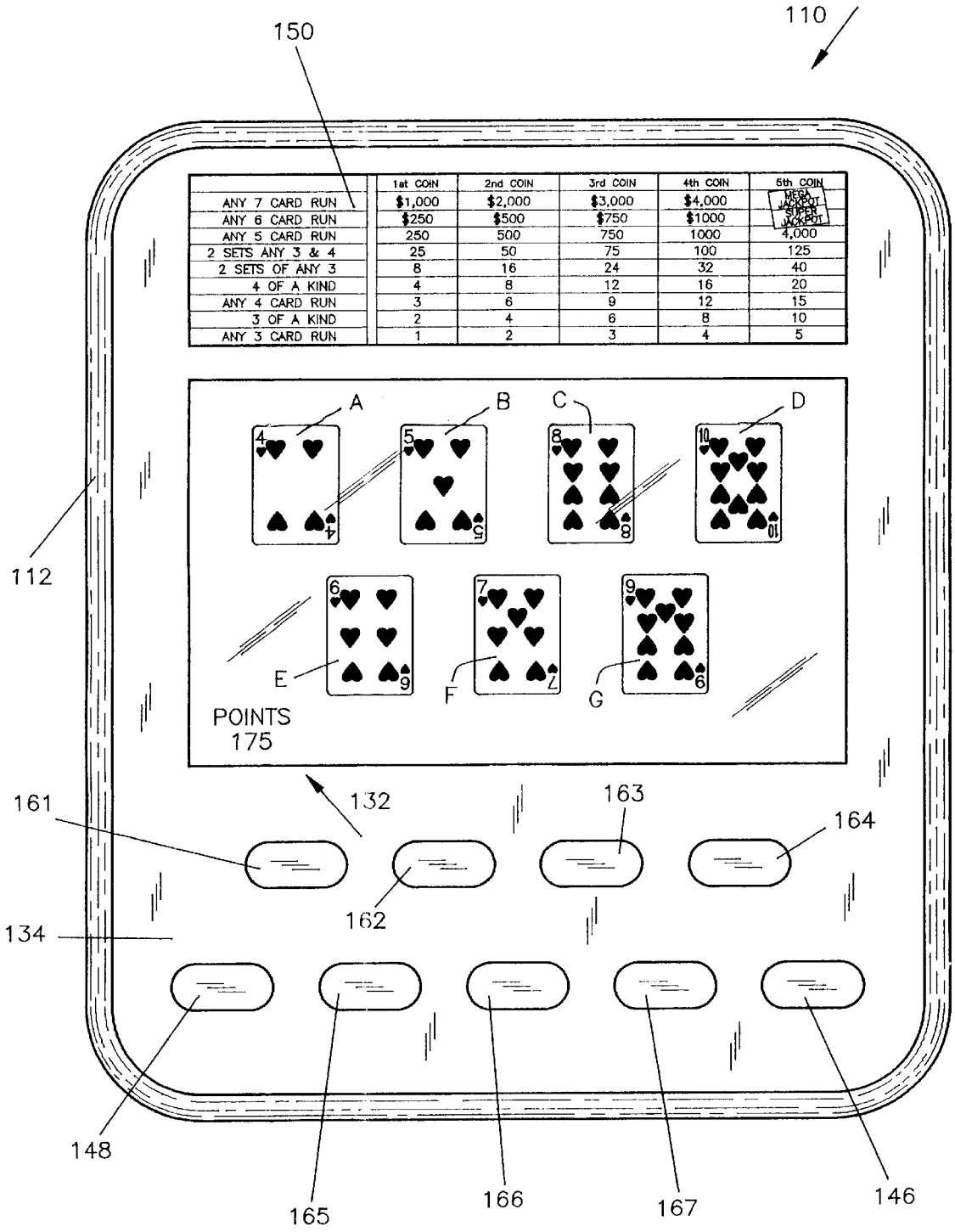
FIG. 5 shows a front view of the hand held amusement apparatus of the present invention.

FIGS. 4 and 5 show the apparatus of the present invention as it relates to a hand held amusement apparatus used to display the method of electronic gin rummy.

The hand held amusement apparatus, shown at 110 in FIGS. 4 and 5, is configured and programmed to display to the player the method of the present invention. The hand held amusement apparatus 110 comprises a housing 112 in which are contained the operating components of the hand held amusement apparatus 110. The hand held amusement device is powered by batteries, or any other suitable power supply, and an access door (not shown) is provided to allow the changing of the batteries.

The operational control of the hand held amusement apparatus 110 is performed by internal electronic circuitry in the form of a electronic circuit board which holds the computer chips and other electronic elements necessary to operate the hand held amusement apparatus 110. The electronic circuit board includes the electronic circuitry necessary to operate the video display screen 130 and the play buttons on the button panel 134. Alternatively, in place of the buttons used to operate the hand held amusement apparatus of the present invention, touch screen technology as described above can be utilized. A conventional electronic circuit board structure is utilized, similar to the electronic circuit boards used in other hand held amusement apparatuses. A specially programmed computer chip, such as an EPROM or other suitable computer chip, is attached to the electronic circuit board and effects the operations of the hand held amusement apparatus necessary to allow a player to engage in the game of the electronic gin rummy as hereinafter described.

The video display screen 130, which can be any conventional display technology, is also electronically connected to the electronic circuit board and the video display screen 130 displays the play of the game to the player. The video display screen 130 will display the playing cards used during the method of play of the game and the video display screen 130 also has a points display 132 which shows the player the number of points currently available to the player which the player may use to play the game.

In the preferred embodiment of the present invention, the hand held amusement apparatus operates in a manner similar to the electronic gaming machine described above, except that the play is for amusement purposes only and no wagering occurs. At the beginning of the play of the game, the player is provided an initial number of points. The player uses these points to activate the hand held amusement apparatus to play the game.

As is conventional in apparatus of this type, the player turns the game on by pressing the Deal/Draw button 146 (or the appropriate location on the touch screen if touch screen technology is being used). The player uses the initial points provided on the points display 132 to begin a round of play of the game. The player presses the Bet Points button 148 (or the appropriate location on the touch screen) to determine the number of points that the player is using in that round of the game. When the Bet Points button 148 is activated (or the appropriate location on the touch screen), a signal is sent to the electronic circuit board which causes the points display 132 to be decremented by the number of points used by the player for that round of the game.

After the player has determined the number of points the player wishes to use in that round of the game, the player presses the Deal/Draw button 146 (or the appropriate location on the touch screen) which sends a signal to electronic circuit board. The computer chip on the electronic circuit board, after having electronically randomly shuffled the playing cards causes playing cards to be displayed on the video display screen 130. In the preferred embodiment of the present invention, seven playing cards are displayed: card A, card B, card C, card D, card E, card F and card G. The computer chip on the electronic circuit board is programmed to use a standard deck of fifty-two playing cards. The cards have the conventional four suits (Spades, Hearts, Diamonds and Clubs) and rank in order from Deuce through Ace. The cards are electronically shuffled using any appropriate shuffling algorithm or method prior to each hand so as to select cards randomly to be displayed to the player.

After the initial deal of the cards, the player may choose which of the playing cards he wishes to hold by pressing the corresponding buttons (or the appropriate location on the touch screen): Card A button 161, Card B button 162, Card C button 163, Card D button 164, Card E button 165, Card F button 166 and/or Card G button 167.

After the player has selected which cards to hold, the player again presses the Deal/Draw button 146 (or the appropriate location on the touch screen). This results in a signal being sent to the electronic circuit board. The computer chip, in response to this signal, causes the cards not held to be removed from the video display screen 130 and replaced with other cards from the deck resulting in a final hand being displayed to the player.

The computer chip on the electronic circuit board also determines whether a winning hand combination has been achieved. This is done by electronically comparing the final displayed hand of cards against a pre-established collection of winning hand combinations stored in the computer chip memory. In addition to being programmed into the computer chip memory, the winning hand combinations are also posted to the player in the payout schedule 150, typically displayed on the apparatus above the video display screen 130. If the final hand is a winning hand, then the player is awarded credits corresponding to the type of winning hand and the number of points used. When the player achieves a winning hand, the points display 132 on the video display screen 130 is incremented with the number of points that the player has won. The player can use the points accrued to continue playing the game.

The apparatus of the present invention can also be modified so that the method of play can be displayed on a stand-alone amusement apparatus of the type found in video arcades or even as a video cartridge suitable for use with a computer or a game entertainment system of the type marketed by SEGA® or NINTENDO®.

While the method of play has been described in connection with electronic gaming and non-gaming amusement apparatus, it is also possible to practice the method of the present invention in a live table gaming format. A gaming table similar to a conventional Twenty-One table can be used (although any suitable table configuration would be acceptable) and a live dealer and live players are situated around the gaming table. Each player makes a wager to participate in the game and the dealer shuffles the cards and deals them to the players. The players examine their hands, discard unwanted cards and receive replacement cards from the dealer. Each player's resulting final hand is compared to a payout schedule to determine if the player has achieved a winning card combination. Each winning card combination receives a payout based on the amount of the player's wager. If it is desired to play the game without wagering, then the wagering and payout steps are eliminated. All of the features and modifications to the method of play described herein can be adapted to the live table game version of the method of the present invention.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game that uses only the player's hand to determine winning and losing outcomes comprising:

a) pre-establishing a group of winning card combinations for the card game, the winning card combinations consisting of a hand having a Six Card Run, a hand having a Five Card Run, a hand having a Four-of-a-Kind, a hand having a Four Card Run, a hand having a Set of 3 & 3, a hand having a Three-of-a-Kind and a hand having a Three Card Run;

b) displaying at least six cards from a standard deck of playing cards;

c) the player selecting which of the cards the player wishes to hold and which of the cards the player wishes to discard;

d) displaying replacement cards for those cards that the player has discarded; and e) determining whether the resulting cards form a winning combination from the pre-established group of winning card combinations.

2. The method of claim 1 further including:

a) a player making a wager to be eligible to participate in the game; and b) paying the player a predetermined amount if the player achieves a winning combination of playing cards.

3. The method of claim 2 in which the winning card combinations are associated in a payout schedule based on the wager made by the player.

4. The method of claim 1 in which the game is displayed on an electronic gaming machine.

5. The method of claim 1 in which the game is displayed on a hand held amusement device.

6. The method of claim 1 in which seven cards are dealt to the player.

7. The method of claim 6 in which the winning card combinations further include a Seven Card Run and a Set of 3 & 4.

8. The method of claim 1 further comprising including at least one Joker in the standard deck of playing cards.

9. The method of claim 1 further comprising designating at least one of the cards of the standard deck of playing cards as a wild card.

10. A method of playing a card game that only uses the player's hand to determine winning and losing outcomes comprising:

a) dealing at least six cards from a standard deck of playing cards including at least one Joker;

b) a player selecting which of the cards the player wishes to hold and which of the cards the player wishes to discard;

c) dealing replacement cards for those cards that the player has discarded;

d) determining whether the resulting cards form a six card run;

e) providing the player an award if a six card run results.

11. A method of playing a card game that only uses the player's hand to determine winning and losing outcomes comprising:

a) dealing at least six cards from a standard deck of playing cards including designating at least one of the cards of the standard deck of playing cards as a wild card;

b) a player selecting which of the cards the player wishes to hold and which of the cards the player wishes to discard;

c) dealing replacement cards for those cards that the player has discarded;

d) determining whether the resulting cards from a six card run;

e) providing the player an award if a six card run results.

12. A method of playing a card game that only uses the player's hand to determine winning and losing outcomes comprising:

a) dealing at least six cards from a standard deck of playing cards including at least one Joker;

b) a player selecting which of the cards the player wishes to hold and which of the cards the player wishes to discard;

c) dealing replacement cards for those cards that the player has discarded;

d) determining whether the resulting cards form a four card run;

e) providing the player an award if a four card run results.

13. A method of playing a card game that only uses the player's hand to determine winning and losing outcomes comprising:

a) dealing at least six cards from a standard deck of playing cards including designating at least one of the cards of the standard deck of playing cards as a wild card;

b) a player selecting which of the cards the player wishes to hold and which of the cards the player wishes to discard;

c) dealing replacement cards for those cards that the player has discarded;

d) determining whether the resulting cards form a four card run;

e) providing the player an award if a four card run results.

14. A method of playing a card game that only uses the player's hand to determine winning and losing outcomes comprising:

a) dealing at least six cards from a standard deck of playing cards including at least one Joker;

b) a player selecting which of the cards the player wishes to hold and which of the cards the player wishes to discard;

c) dealing replacement cards for those cards that the player has discarded;

d) determining whether the resulting cards form a three card run;

e) providing the player an award if a three card run results.

15. A method of playing a card game that only uses the player's hand to determine winning and losing outcomes comprising:

a) dealing at least six cards from a standard deck of playing cards including designating at least one of the cards of the standard deck of playing cards as a wild card;

b) a player selecting which of the cards the player wishes to hold and which of the cards the player wishes to discard;

c) dealing replacement cards for those cards that the player has discarded;

d) determining whether the resulting cards form a three card run;

e) providing the player an award if a three card run results.

16. A method of playing a card game that only uses the player's hand to determine winning and losing outcomes comprising:

a) dealing at least six cards from a standard deck of playing cards;

b) a player selecting which of the cards the player wishes to hold and which of the cards the player wishes to discard;

c) dealing replacement cards for those cards that the player has discarded;

d) determining whether the resulting cards form a set of a three card run and a three-of-a-kind;

e) providing the player an award if a set of a three card run and a three-of-a-kind results.

17. The method of claim 16 further including:

a) a player making a wager to be eligible to participate in the game; and b) paying the player a predetermined amount if the player achieves a winning combination of playing cards.

18. The method of claim 17 in which the winning card combinations are associated in a payout schedule based on the wager made by the player.

19. The method of claim 16 further comprising including at least one Joker in the standard deck of playing cards.

20. The method of claim 16 further comprising designating at least one of the cards of the standard deck of playing cards as a wild card.

21. A method of playing a card game that only uses the player's hand to determine winning and losing outcomes comprising:

a) dealing at least six cards from a standard deck of playing cards including at least one Joker;

b) a player selecting which of the cards the player wishes to hold and which of the cards the player wishes to discard;

c) dealing replacement cards for those cards that the player has discarded;

d) determining whether the resulting cards form a set of two three-of-a-kinds;

e) providing the player an award if a set of two three-of-a-kinds results.

22. A method of playing a card game that only uses the player's hand to determine winning and losing outcomes comprising:

a) dealing at least six cards from a standard deck of playing cards including designating at least one of the cards of the standard deck of playing cards as a wild card;

b) a player selecting which of the cards the player wishes to hold and which of the cards the player wishes to discard;

c) dealing replacement cards for those cards that the player has discarded;

d) determining whether the resulting cards form a set of two three-of-a-kinds;

e) providing the player an award if a set of two three-of-a-kinds results.

23. A method of playing a card game that only uses the player's hand to determine winning and losing outcomes comprising:

a) dealing at least six cards from a standard deck of playing cards;

b) a player selecting which of the cards the player wishes to hold and which of the cards the player wishes to discard;

c) dealing replacement cards for those cards that the player has discarded;

d) determining whether the resulting cards form a set of two three card runs;

e) providing the player an award if a set of two three card runs results.

24. The method of claim 23 further including:

a) a player making a wager to be eligible to participate in the game; and b) paying the player a predetermined amount if the player achieves a winning combination of playing cards.

25. The method of claim 24 in which the winning card combinations are associated in a payout schedule based on the wager made by the player.

26. The method of claim 23 further comprising including at least one Joker in the standard deck of playing cards.

27. The method of claim 23 further comprising designating at least one of the cards of the standard deck of playing cards as a wild card.

* * * * *